US005203679A

United States Patent [19]

Yun et al.

[11] Patent Number: 5,203,679

[45] Date of Patent: Apr. 20, 1993

[54] RESONATOR FOR HERMETIC ROTARY COMPRESSOR

[75] Inventors: Kyungwoo Yun, Hilliard, Ohio; Insoo Whang, Kwangju, Rep. of Korea

[73] Assignee: Daewoo Carrier Corporation, Kwangju, Rep. of Korea

[21] Appl. No.: 780,583

[22] Filed: Oct. 22, 1991

[30] Foreign Application Priority Data

Oct. 22, 1990 [KR] Rep. of Korea ..... 90-16862

[51] Int. Cl.[5] ..... F04B 39/00; F01N 1/02

[52] U.S. Cl. ..... 417/312; 181/403; 181/269

[58] Field of Search ..... 417/312; 181/403, 264, 181/269

[56] References Cited

U.S. PATENT DOCUMENTS

| | | | |
|---|---|---|---|
| 2,738,657 | 3/1956 | Jacobs | 417/312 |
| 4,573,879 | 3/1986 | Uetuji | 181/403 |
| 4,730,996 | 3/1988 | Akatsuchi et al. | 417/312 |
| 4,781,545 | 11/1988 | Yokomizo et al. | 417/312 |
| 4,927,342 | 5/1990 | Kim et al. | 181/403 |
| 4,990,073 | 2/1991 | Kudo et al. | 181/403 |
| 5,004,410 | 4/1991 | Da Costa | 181/403 |

*Primary Examiner*—Richard A. Bertsch
*Assistant Examiner*—Peter Korytnyk
*Attorney, Agent, or Firm*—Skjerven, Morrill, MacPherson, Franklin & Friel

[57] ABSTRACT

A resonator of a hermetic rotary compressor in which noise is reduced to a maximum extent by effectively absorbing high frequency pressure components inside a cylinder of the compressor. The resonator comprises a resonator space of bi-level configuration disposed between a bearing flange and a matching cylinder face surface. This resonator space communicates with a discharge part defined in the compressor through an entrance channel which has a tapered surface to form a narrow inlet and a wide outlet. With this construction, the resonator effectively reduces the high frequency component out of gas pulsation generated in the cylinder.

1 Claim, 9 Drawing Sheets

FREQUENCY ANALYSIS OF GAS PULSATION INSIDE CYLINDER IN CASE WITH NO RESONATOR

FREQUENCY ANALYSIS OF GAS PULSATION INSIDE CYLINDER IN CASE WITH RESONATOR

RESONATOR FOR HERMETIC ROTARY COMPRESSOR

BACKGROUND OF THE INVENTION

1. Field of the Invention

This invention concerns a hermetic rotary compressor for an air conditioning application. In particular, this invention relates to resonator for a hermetic rotary compressor capable of a certain extent of noise reduction.

2. Description of the Prior Art

The best method of noise reduction in compressors lies in dealing with the source of noise, i.e., in reducing high frequency components of gas pulsation.

In the past, means such as mufflers, Helmholtz resonators, and orifices have been used for noise reduction. Mufflers and orifices are inherently restricted to be designed into rotary compressor components because of large physical dimension which is normally required for adequate noise reduction.

Compared to those, a resonator can provide physical design parameters which are adequate for reducing gas pulsation. However, designing a resonator with target center frequency and frequency band with certain magnitude of desired noise reduction is also geometrically restricted in many ways to be installed into a limited space in compressor. A resonator is composed of a chamber and an entrance channel connected thereto. The channel communicates the resonator chamber and compression chamber. A medium in the entrance channel acts as a mass, while that in the chamber acts as a spring. Thus, the volume of the chamber and the cross-sectional area and length of the entrance channel are parameters which determine target center frequency and frequency band with certain magnitude of desired noise reduction.

Increasing volume of resonator increases frequency band with certain magnitude of desired noise reduction, thereby resulting in an increase in noise reduction. Thus, a need to maximize frequency band with certain noise reduction effect while minimizing efficiency penalty arises.

Therefore, a method of designing a resonator of adequate configuration which is not restricted in geometry while providing desired target center frequency and frequency band with certain magnitude of desired noise reduction has been in demand and desirable.

SUMMARY OF THE INVENTION

Accordingly, it is an object of the invention to provide a resonator for a hermetic rotary compressor in which noise is reduced to a maximum extent by effectively absorbing high frequency pressure components inside the cylinder.

Another object of the invention is to provide a resonator for a hermetic rotary compressor which is capable of maximizing noise reduction without compromising the performance of the compressor.

Still another object of the invention is to provide a resonator for a hermetic rotary compressor in which a large volume of resonator can be built in a given restricted space or area.

In accordance with this invention, the above objects can be accomplished by providing an hermetic rotary compressor comprising an electric motor fixedly mounted in said compressor, a cylinder located below said motor and provided with an eccentric shaft extending into said cylinder, said shaft being connected to the shaft of motor, a piston fitting over the eccentric shaft and disposed in the cylinder such that a space is defined between the inner surface of cylinder and the outer surface of the piston, a sliding vane slidably mounted in the cylinder and adapted to divide said space into a suction chamber and a compression chamber, upper and lower bearing flanges bolted to both vertical ends of the cylinder, respectively, a vertical discharge port formed at the upper flange and adapted to discharge compressed gas in said compression chamber into the interior of compressor, and a resonator space provided at the lower surface of said upper flange to communicate with said discharge port by means of an entrance channel provided between the resonator space and the discharge port, the compressor being characterized in that said entrance channel has a tapered surface diverging toward the resonator space, so as to form a narrow inlet connected to the discharge port and a wide outlet connected to the resonator space, and that the resonator space comprises two resonator chambers of different levels.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
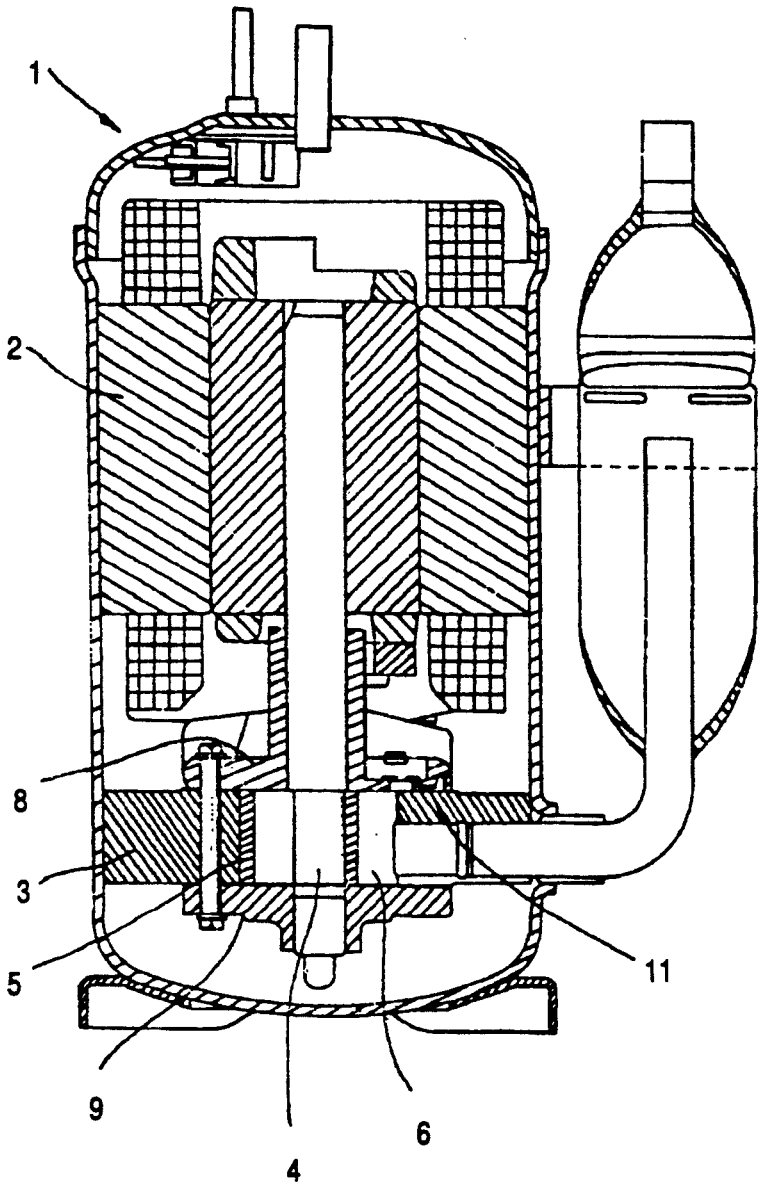
FIG. 1 is a sectional view of overall construction of a hermetic rotary compressor to which this invention is applied.
Figure 2:
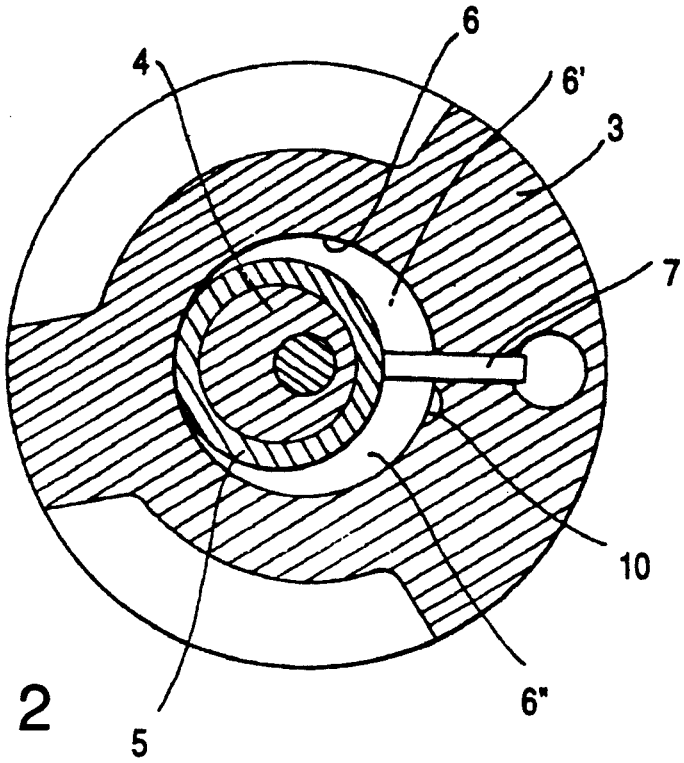
FIG. 2 is a cross-sectional view of the compressor of FIG. 1, showing operational principle of this invention.
Figure 3:
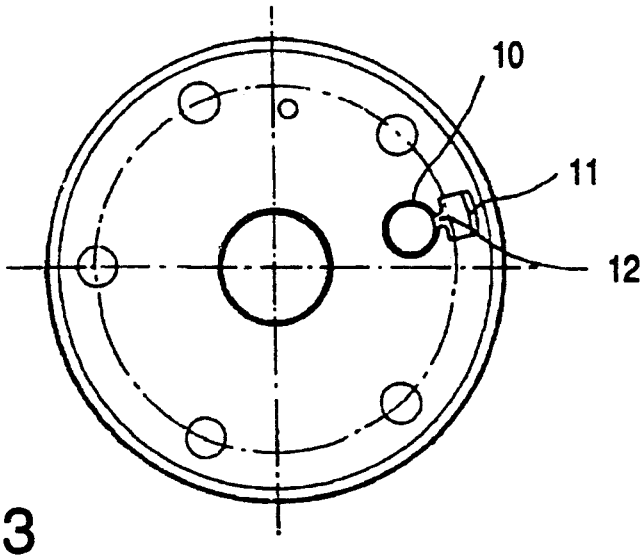
FIG. 3 is a bottom view of an upper bearing flange of the compressor.
Figure 5:
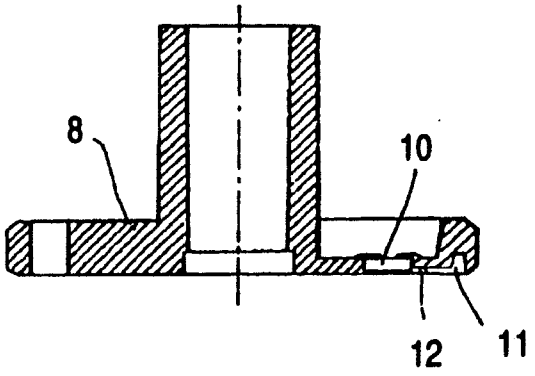
FIG. 5 is a sectional view of the upper bearing flange shown in FIG. 3.

Referring to FIG. 1, there is shown a sectional view of overall construction of a hermetic rotary compressor to which this invention is applied. As shown in the drawing, the compressor 1 comprises an electric motor 2 fixedly mounted therein. A cylinder 3 is located below the motor 2. An eccentric shaft 4 which is connected to the shaft of motor 2 extends into the cylinder 3. A piston 5 fits over the eccentric shaft 4 and is disposed in the cylinder 3 such that a space 6 is defined between the inner surface of cylinder 3 and the outer surface of the piston 5. The space is divided into a suction chamber 6' and a compression chamber 6" by means of a sliding vane 7 slidably mounted in the cylinder 3, as shown in FIG. 2 to both vertical ends of the cylinder 3, upper and lower bearing flanges 8 and 9 are bolted, respectively. A vertical discharge port 10 is formed at the upper flange 8, so as to discharge compressed gas into the interior of compressor 1. The upper flange 8 is also provided at its lower surface with a radial groove communicating with the discharge port 10. Together with the upper surface of cylinder 3, the groove defines a resonator space 11. An entrance channel 12 is provided for communicating the resonator space 11 and the discharge port 10.

Figure 6:
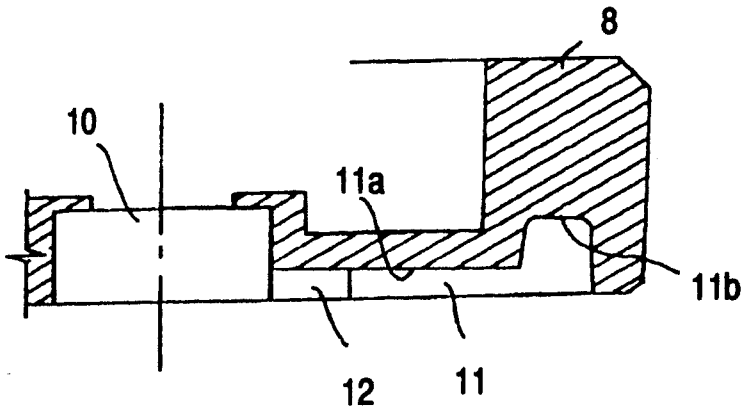
FIG. 6 is a partially enlarged sectional view of the upper bearing flange, showing the resonator of this invention.
Figure 4:
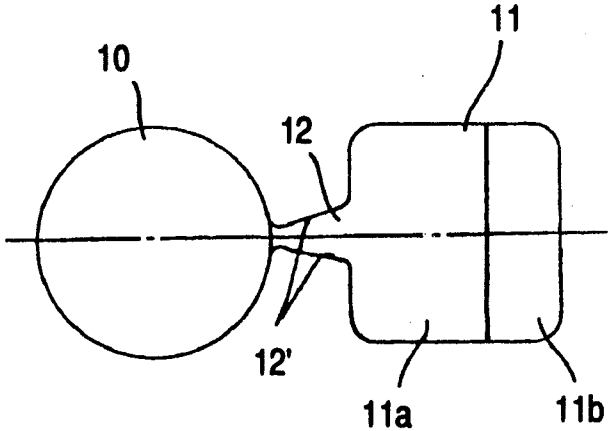
FIG. 4 is a schematic enlarged view of a resonator in accordance with this invention.

In accordance with this invention, the entrance channel 12 has a tapered surface 12' diverging toward the resonator space 11, so as to form a narrow inlet connected to the discharge port 10 and a wide outlet connected to the resonator space 11, as shown in FIG. 4. This divergence of the entrance channel 12 results in effective noise reduction, as will be described hereinafter. On the other hand, the resonator space 11 comprises two resonator chambers 11*a* and 11*b* of different levels or depths, as shown in FIG. 6. The level of the second resonator chamber 11*b* is higher than that of the first resonator chamber 11*a*. This bi-level construction makes it possible to maximize the noise reduction and minimize the ineffectiveness of the resonator, as will be described hereinafter.

Figure 7:
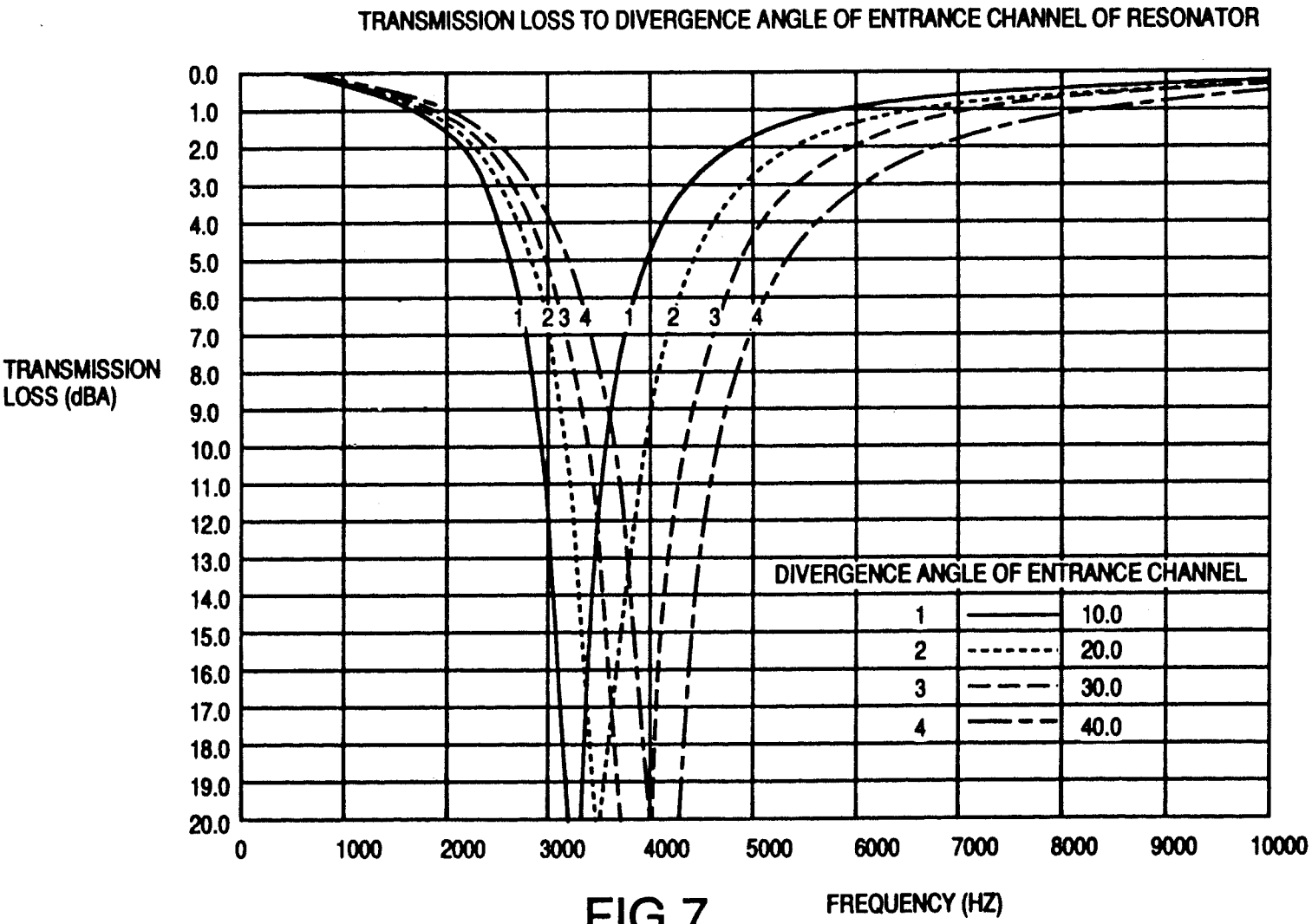
FIG. 7 is a graph showing transmission loss as a function of divergence angle of an entrance channel of a resonator.

FIG. 7 illustrates the fact that a change in the taper angle or divergence angle in the entrance channel 12 changes in center frequency and frequency band width of a given noise reduction level. As the angle increases, the curve moves in the direction of 1→2→3→4. In other words, as diverging angle of the entrance channel 12 toward the resonator space 11 increases, the center frequency shifts in the direction of higher frequency, and the width of frequency band with a certain noise reduction level increases. These variations may be exhibited even in cases of constant volume of the resonator space or constant cross-sectional area and length of the entrance channel.

On order to widen the frequency band with a certain noise reduction level, it is necessary to increase the volume of resonator space. However, the increase unfavorably affects volumetric efficiency of the compressor. Then, a need to reduce noise without sacrificing performance is desirable and this can be accomplished by diverging the entrance channel toward the resonator space. The divergence results in a wider frequency band which realizes a maximum noise reduction, while making the resonator volume insensitive to the compressor performance (capacity and energy efficiency ratio). Therefore, a resonator with a diverging entrance channel is more effective in reducing compressor noise for a given noise reduction level.

In addition, room for installing a resonator is very limited in the vicinity of discharge port area, and this geometrically restricts designating an effective resonator. The fact that the diverging angle of entrance channel toward the resonator space moves the center frequency toward a higher frequency provides an important advantage in designing a resonator.

In order to move the target center frequency toward higher frequency, either the length of the entrance channel must be shortened or the cross-sectional area of the inlet of the channel must be enlarged. However, both of these changes create tolerance variations in the entrance channel dude to entrance effect and frictional effects caused by the increased surface area of the entrance channel, thus resulting in less effective noise reduction.

Though the movement of target center frequency in the direction of higher frequency can be accomplished by reducing the volume of resonator space, it also reduces the width of frequency band with a certain noise reduction level.

Figure 8:
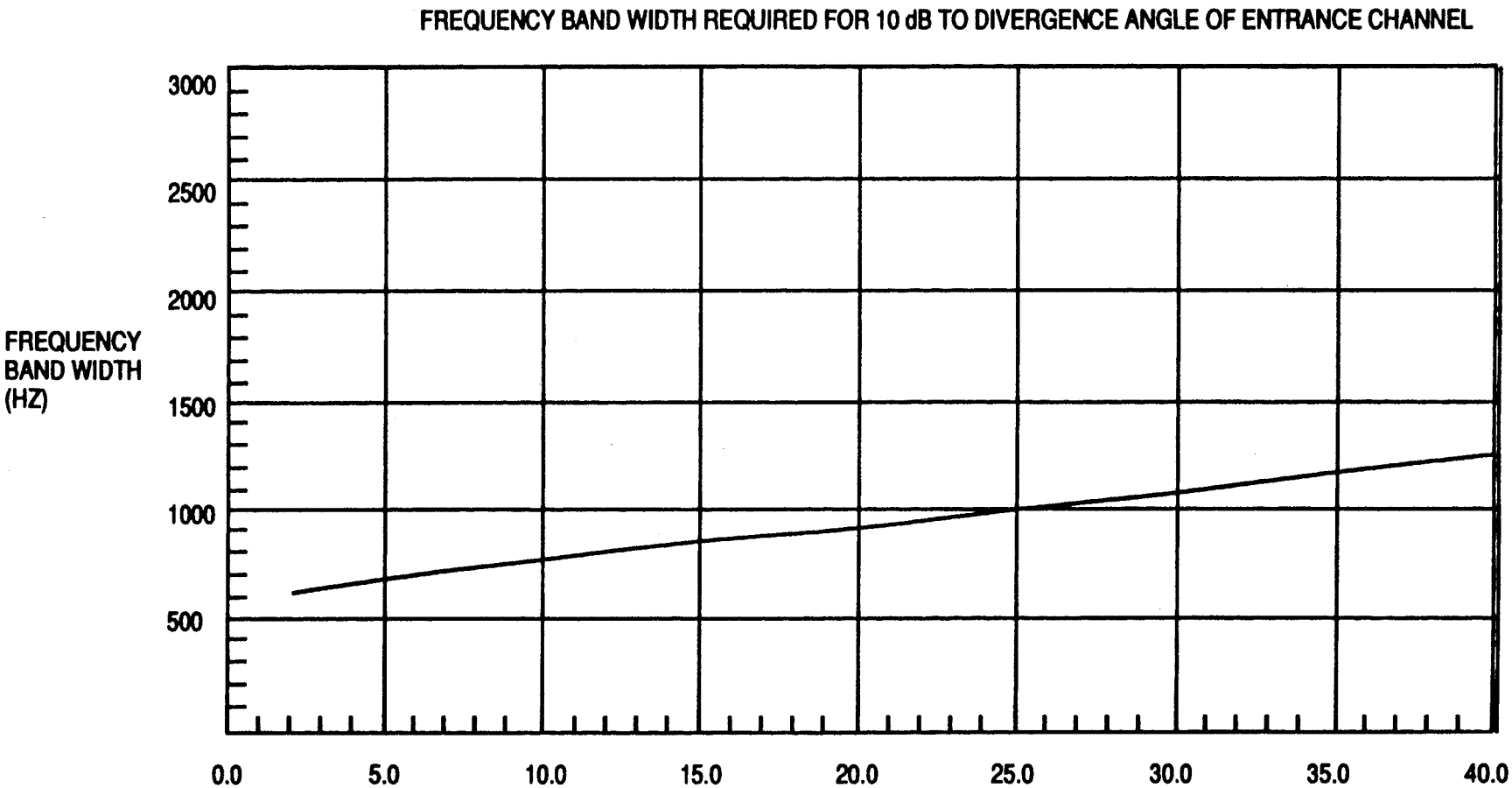
FIG. 8 is a graph showing the width of frequency band required for 10 dB reduction as a function of divergence angle of an entrance channel.

FIG. 8 illustrates the fact that the frequency band for a given noise reduction level (for example, 10 dB) can be widened by increasing the angle of divergence in the entrance channel, in accordance with this invention. This shows the increased effectiveness of noise reduction according to the increase of the width of the frequency band with a certain noise level, by virtue of the diverging entrance channel.

Figure 9:
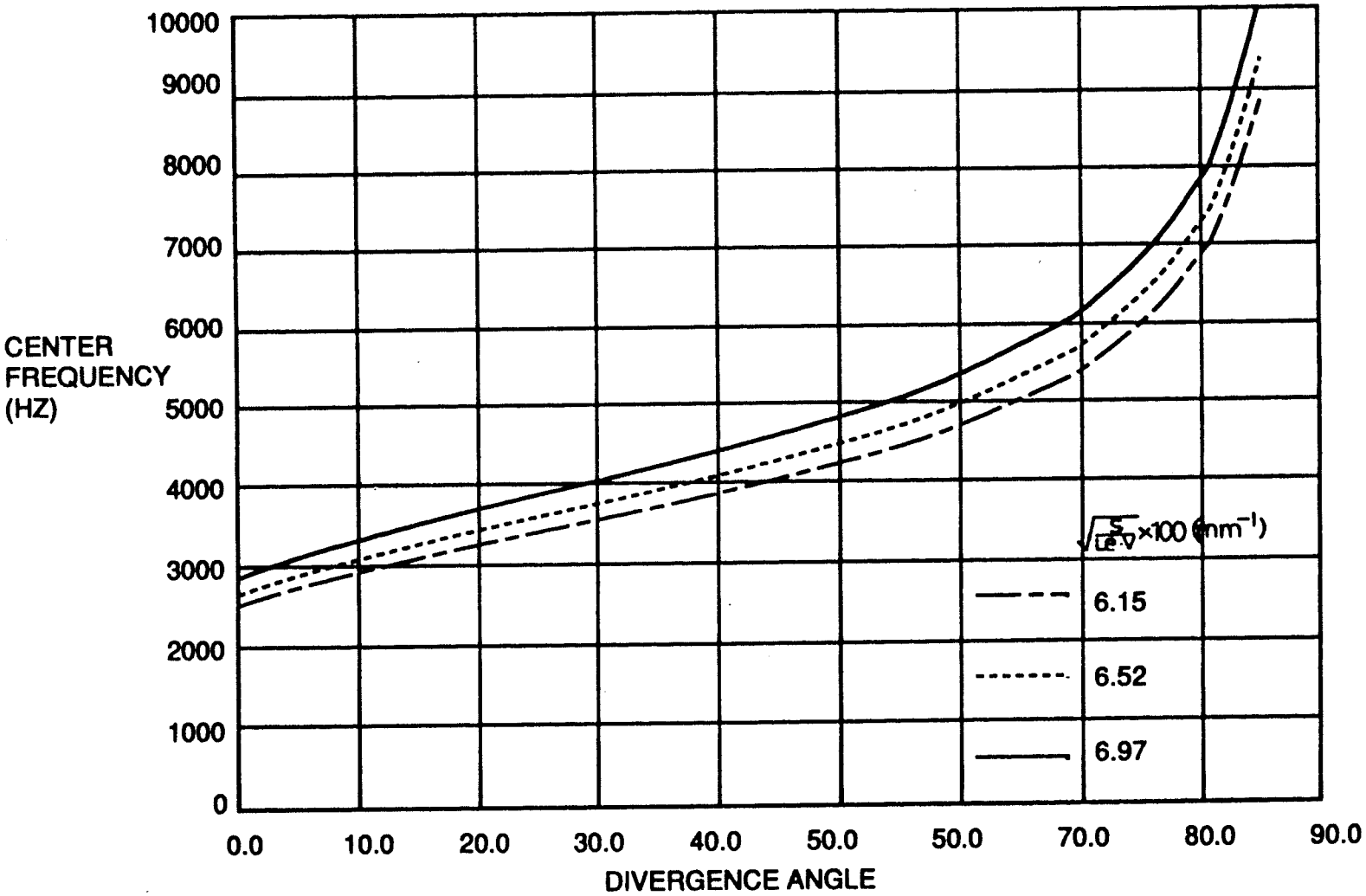
FIG. 9 is a graph showing center frequency of a resonator as a function of divergence angle of an entrance channel.

FIG. 9 illustrates the movement of target center frequency according to the variation of the divergence angle of entrance channel. In the case of no divergence in the entrance channel, as in the prior art, the target center frequency of the resonator is proportional to square root of cross-sectional area of the entrance channel divided by the value obtained by multiplying the effective length (that is, actual channel length plus a value adjusted for entrance effect) with the volume of resonator space. The figure is drawn for a constant value of above in order to illustrate the fact that as the angle of divergence increases, so does the center frequency, regardless of other parameters (volume, length and cross-sectional area of entrance channel).

Figure 10:
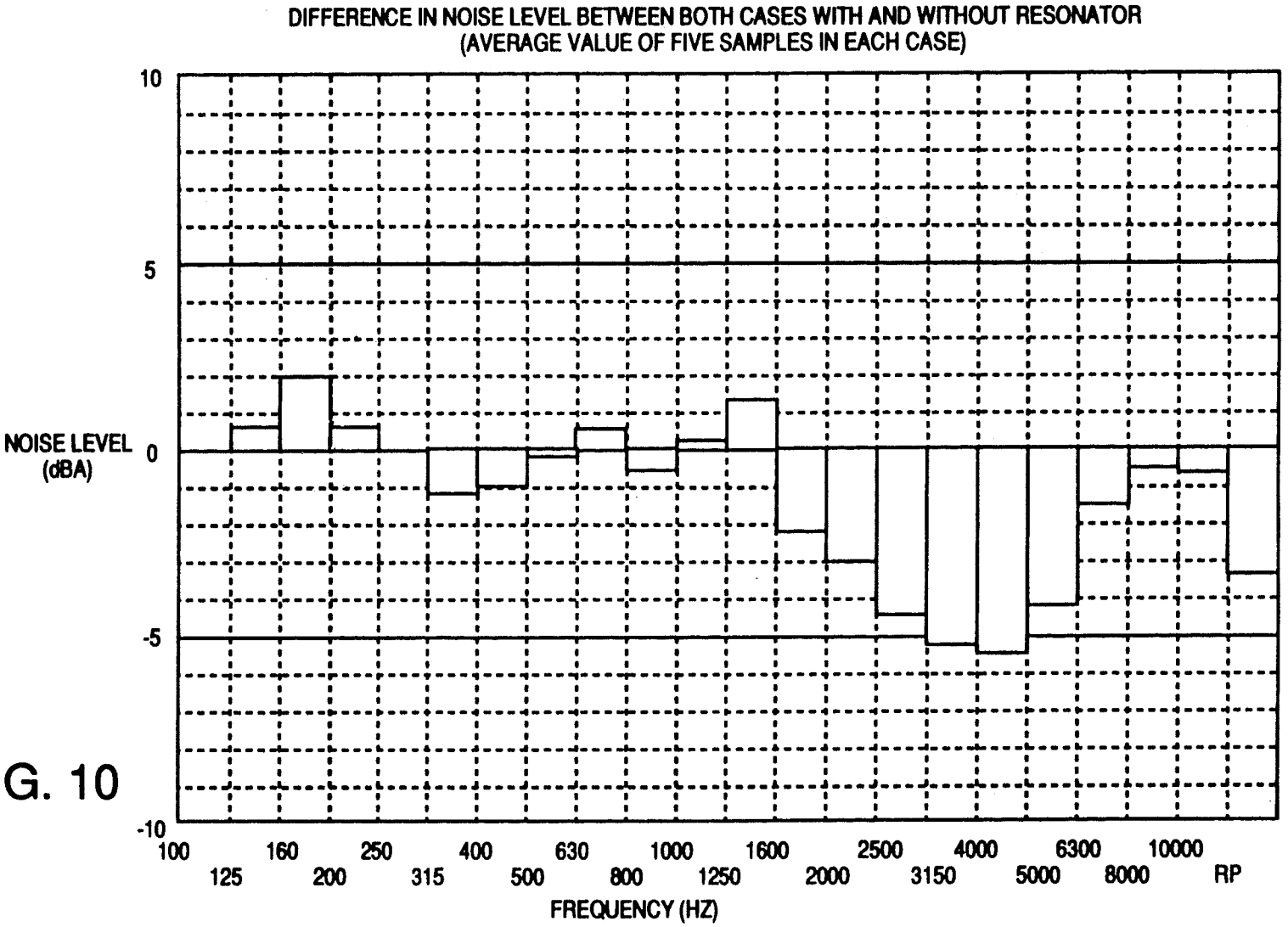
FIG. 10 is a graph showing the difference in average noise level between both cases equipped with and without a resonator of this invention.

FIG. 10 shows the difference in average noise level for a sample size of five each, in third-octave band, between with and without a resonator of this invention installed. It can be found from the figure that the difference in average noise level is remarkably exhibited at higher frequency.

Figure 11:
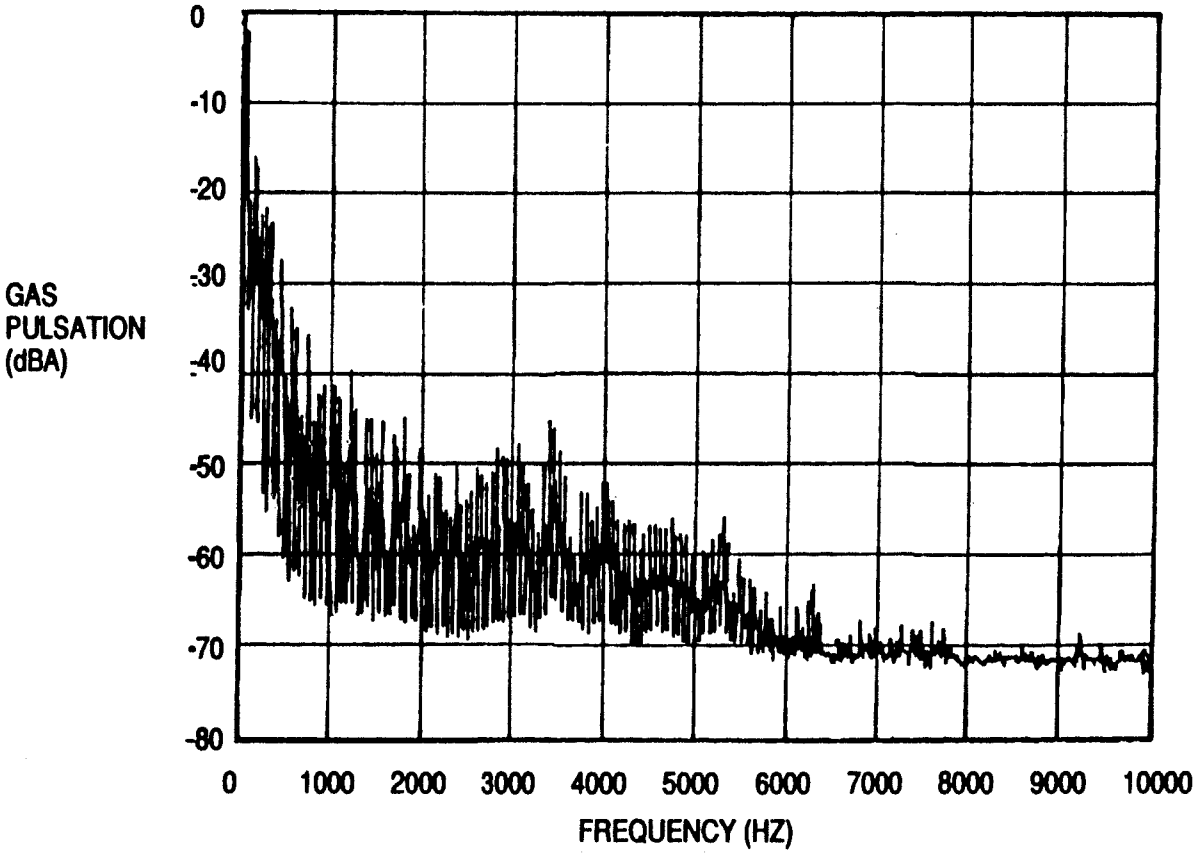
FIG. 11 is a graph showing the frequency analysis of gas pulsation inside a cylinder, in the case that no resonator of this invention is installed.
Figure 12:
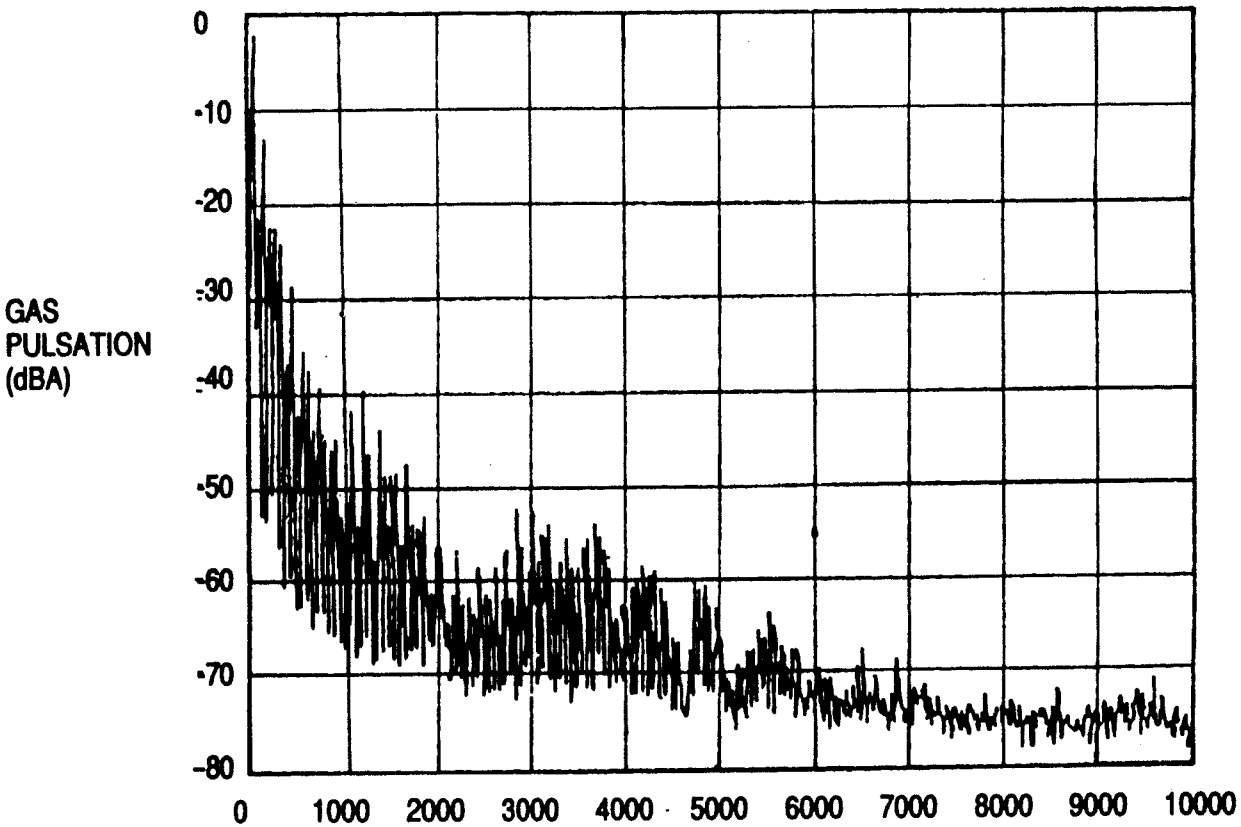
FIG. 12 is a graph showing the frequency analysis of gas pulsation inside a cylinder, in the case that a resonator of this invention is installed.

FIGS. 11 and 12 depict a frequency analysis of gas pulsation inside cylinder chamber, without and with a resonator of this invention installed respectively. The gas pulsation inside the cylinder chamber acts as the prime cause of compressor noise. The fact is illustrated that the resonator according to this invention reduces the gas pulsation in 2 to 5 KHz frequency range.

Further detailing the effectiveness of this invention in the following, high frequency gas pulsation being the prime cause of compressor noise which is generated in the cylinder. In accordance with this invention, a resonator space and an entrance channel, both of unique geometric features are built in the contact area between the upper surface of cylinder and the lower surface of upper bearing flange. The diverging entrance channel makes it possible to shift center frequency as desired and to widen the width of frequency band. The resonator space having two chambers constructed in different depths, i.e., in bi-level construction makes it possible to increase the width of frequency band with a certain noise reduction level. This, in turn, maximizes noise reduction without compromising the performance of compressor. Additionally, the resonator chambers make it possible to build in a large volume of resonator in a given restricted space or area. One major advantage of this geometric configuration is minimizing the ineffectiveness of resonator when the resonator chambers are filled with liquid refrigerant, refrigerating oil, or mixture thereof.

As apparent from the above description, this invention while leaving the design parameters (for example, volume of resonator space, cross-sectional area and height of entrance channel) which determine the effectiveness of resonator constant, shift of center frequency and widening of frequency band can be accomplished with delivering angle in the entrance channel. This invention facilitates installation of an effective resonator with optimized design parameters in a geometrically restricted area and space, as well as minimizes the reduced effectiveness of the resonator due to filling of the resonator by liquid refrigerant and refrigerant oil. As a result, this invention maximizes noise reduction effect by obtaining appropriate geometry in the design parameters of a resonator.

Although the preferred embodiments of the invention have been disclosed for illustrative purpose, those skilled in the art will appreciated that various modifications, additions and substitutions are possible, without departing from the scope and spirit of the invention as disclosed in the accompanying claims.

What is claimed is:

1. An hermetic rotary compressor comprising an electric motor fixedly mounted in said compressor, a cylinder located below said motor and provided with an eccentric shaft extending into said cylinder, said shaft being connected to a shaft of said motor, a piston fitting over the eccentric shaft and disposed in the cylinder such that a space is defined between the inner surface of the cylinder and the outer surface of the piston, a sliding vane slidably mounted in the cylinder and adapted to divide said space into a suction chamber and a compression chamber, upper and lower bearing flanges bolted to vertical ends of the cylinder, respectively, a vertical discharge port formed at the upper flange and adapted to discharge compressed gas in said compression chamber into the interior of said compressor; and a resonator space provided at a lower surface of said upper flange to communicate with said discharge port by means of an entrance channel extending horizontally between the resonator space and the discharge port, said compressor being characterized in that said entrance channel has a tapered surface diverging toward the resonator space, so as to form a narrow inlet connected to the discharge port and a wide outlet connected to the resonator space, wherein the resonator space comprises two resonator chambers of different depths.

* * * * *

UNITED STATES PATENT AND TRADEMARK OFFICE

CERTIFICATE OF CORRECTION

PATENT NO. : 5,203,679
DATED : April 20, 1993
INVENTOR(S) : Yun et al

It is certified that error appears in the above-indentified patent and that said Letters Patent is hereby corrected as shown below:

Column 4, line 8, delete "dude" and substitute --due--.

Signed and Sealed this

Eighth Day of February, 1994

Bruce Lehman

*Attest:*

BRUCE LEHMAN

*Attesting Officer*

*Commissioner of Patents and Trademarks*